United States Patent [19]

Clemens

[11] Patent Number: 4,812,952

[45] Date of Patent: Mar. 14, 1989

[54] SELF-ILLUMINATING FLORAL DEVICE

[76] Inventor: Gregory Clemens, 501-A E. Second St., Berwick, Pa. 18603

[21] Appl. No.: 29,784

[22] Filed: Mar. 25, 1987

[51] Int. Cl.[4] ..... F21V 9/16

[52] U.S. Cl. ..... 362/84; 362/805; D7/42

[58] Field of Search ..... 362/34, 84, 102, 805, 362/806; 47/47; D7/42; D11/184

[56] References Cited

U.S. PATENT DOCUMENTS

| | | | |
|---|---|---|---|
| D. 249,193 | 8/1978 | Buecher, Jr. | D7/42 |
| 2,717,463 | 9/1955 | Sindler | D7/42 |
| 3,934,539 | 1/1976 | Little et al. | 362/34 |
| 3,938,465 | 2/1976 | Lyons | 362/34 |
| 4,037,361 | 7/1977 | Murphy et al. | D7/42 |
| 4,106,079 | 8/1978 | Drury | 362/34 |

FOREIGN PATENT DOCUMENTS

| | | | |
|---|---|---|---|
| 744172 | 5/1944 | Fed. Rep. of Germany | 362/34 |

*Primary Examiner*—E. Rollins Cross
*Attorney, Agent, or Firm*—Anthony J. Dixon

[57] ABSTRACT

A combination decorative set in with a light source to be utilized in foral arrangements for a variety of designs.

2 Claims, 1 Drawing Sheet

SELF-ILLUMINATING FLORAL DEVICE

The present invention relates to decorations for flower arrangements and the like. More particularly it relates to stick-in types of decorations often used in flower arrangement, bouquets and the like.

More particularly the present invention relates to stick-in decorations which are illuminated by a self-contained light producing means.

SUMMARY OF THE INVENTION

Recently, portable, lightweight, chemiluminescent light sources have been developed for various uses, especially in emergency use. These chemiluminescent light sources include a part of reactment compounds, one of which is in a thin glass tube and another in a pliable plastic tube which surrounds the thin glass tube. Such a light source is described in U.S. Pat. No. 3,675,987. By bending the outer pliable container, the inner container is broken. As a result the compounds mix and intermingle. The resultent reaction produces a non-heat generating light source which lasts for a period of time.

This type of light source is embodied in available light sticks made and marketed by American Cyanamid Company of Wayne, N.J. and are sold under the tradename CYALUME ®.

This technology has been adapted to other uses such as plastic toys in U.S. Pat. No. 4,086,723 and illuminated mugs in U.S. Pat. No. 4,503,726.

A new combination has now been discovered using this technology in the field of floral arrangements, the plant arts and the like.

Decorative devices have been used in these arts for long periods of time. Often, the decorative sticks used in a flower pot is combined with a utilitarian support function such as holding up a delicate flower.

In arranging, the use of a supportive stick is often the center piece of the entire arrangement.

Therefore a need continues to exist for new, useful and unique additions to the floral and plant arts.

Such a need has been met by the present invention which comprises a combination decorative stick-in with a light source which can then be inserted, in any floral arrangement. Various designs are available for such a combination and can be better understood and explained with reference to the accompanying drawing and the description of the preferred embodiment which follow.

THE PREFERRED EMBODIMENT

Figure 1:
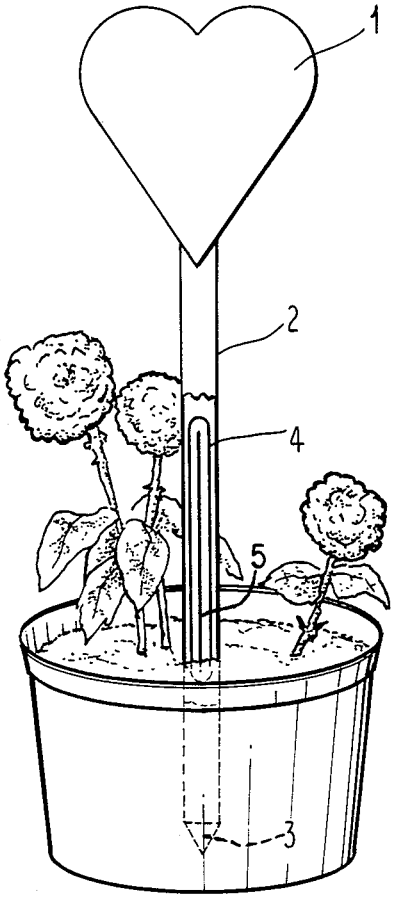
FIG. 1 is a side elevation of the present invention with one type of decorative top.
Figure 2:
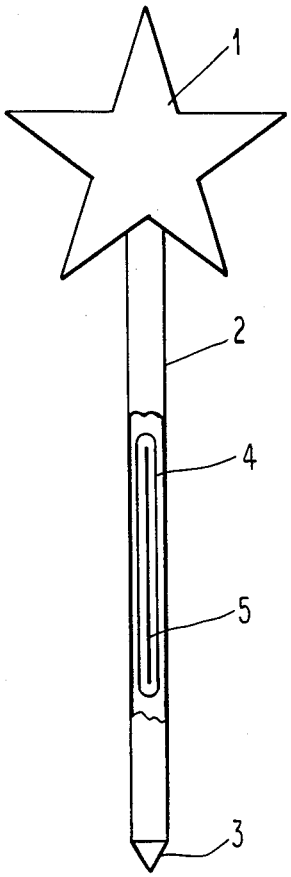
FIG. 2 is a view of the invention with a different decorative top.
Figure 3:
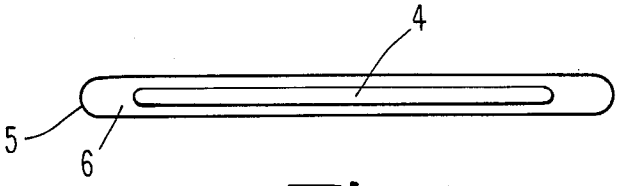
FIG. 3 is a view of the light insert which is combined in FIGS. 1 and 2 with the stick-in device.

Referring to FIGS. 1, 2 and 3 the present invention can be better understood.

The decorative stick-in is comprised of a decorative top, 1 mounted on a flexible shaft, 2 which has a sharpened end, 3 on the end opposite the decoration.

In the present invention, the shaft has mounted therein a light source, 5 which comprises an outer container, 6 and an inner container, 4. Upon use of the device a slight bend in the shaft, 2 will cause the container, 5 to bend. The other container, 6 is flexible and contains the chemical which will mix with these in the inner glass container, 4 resulting in a light source which illuminates both the flower or plant and the decorative top, 1. The stick is placed in the flower or arrangement and provides the lighted affect for the duration of the illuminating reaction taking place therein.

As a further embodiment, the light stick itself can be mounted to the decorative top, 1 and its other end can be inserted into the usually soft earth of a floral arrangement or plant.

It will be understood that the length and width of the stick portion, 2 and the selection of decorative tops, 1 is almost limitless, for example, Christmas themes, numbers for birthdays, hearts as shown, flowers, various logos and the like all of which can be used without departing from the scope of the present invention.

I claim as my invention:

1. In a floral arrangement, a stick-in decoration in combination with the floral arrangement comprising:

(a) a decorative portion, (b) a flexible, hollow, shaft portion connected on one end of the decorative portion, (c) a chemiluminescent light stick positioned within the shaft portion.

2. The stick-in decoration of claim 1 wherein the shaft portion is comprised of a chemiluminescent light stick.

* * * * *